US005774039A

United States Patent [19]

Housley

[11] Patent Number: 5,774,039

[45] **Date of Patent: *Jun. 30, 1998**

[54] PROGRAMMABLE DOORBELL CONTROL

[76] Inventor: Todd B. Housley, 7605 Mabray Dr., Plano, Tex. 75025

[ * ] Notice: The term of this patent shall not extend beyond the expiration date of Pat. No. 5,210,520.

[21] Appl. No.: 231,615

[22] Filed: Apr. 22, 1994

Related U.S. Application Data

[63] Continuation-in-part of Ser. No. 62,615, May 11, 1993, abandoned, which is a continuation of Ser. No. 735,096, Jul. 23, 1991, Pat. No. 5,210,520, which is a continuation of Ser. No. 408,613, Sep. 18, 1989, abandoned, which is a continuation-in-part of Ser. No. 73,456, Jul. 15, 1987, Pat. No. 4,868,540.

[51] Int. Cl.[6] ..... G08B 27/00

[52] U.S. Cl. ..... 340/326; 340/392; 340/330; 379/56; 379/67

[58] Field of Search ..... 340/326, 330, 340/328, 329, 392, 393; 379/103

[56] References Cited

U.S. PATENT DOCUMENTS 5,148,468 9/1992 Marrick et al. ..... 379/56

5,210,520 5/1993 Housley ..... 340/326

*Primary Examiner*—Jeffery A. Hofsass
*Assistant Examiner*—Daryl C. Pope

[57] ABSTRACT

A programmable doorbell controller for the operation of a doorbell. In a preferred embodiment, an audible announcement is recorded and stored by a doorbell control module using speech controller integrated circuitry. A self-contained remote module may interface with the doorbell control module by means of a wireless intercom system. When the doorbell actuation means is actuated, the remote module transmits a tone or signal that is received and detected by the doorbell control module. In response, the doorbell control module activates an internal speech controller circuitry to generate a playback of a stored audible announcement. Similarly, a visitor can easily respond by actuating a recording actuation means to activate a microphone for generating a responsive audible message that can be transmitted to the control module for encoding and storage. In this manner, the visitor's audible message is encoded, recorded and stored by the speech controller integrated circuitry of the control module for playback.

29 Claims, 10 Drawing Sheets

PROGRAMMABLE DOORBELL CONTROL

RELATED APPLICATIONS

This application is a continuation-in-part of my co-pending application Ser. No. 08/062,615, filed on May 11, 1993 for PROGRAMMABLE DOORBELL CONTROL, now abandoned, which is a continuation of application Ser. No. 07/735,096, filed Jul. 23, 1991 for PROGRAMMABLE DOORBELL CONTROL, now issued as U.S. Pat. No. 5,210,520, which is a continuation of application Ser. No. 07/408,613, filed Sep. 18, 1989, now abandoned, which is a continuation-in-part of an application entitled PROGRAMMABLE DOORBELL CONTROL, filed Jul. 15, 1987 and assigned Ser. No. 073,456, now issued as U.S. Pat. No. 4,868,540.

FIELD OF THE INVENTION

This invention relates to controllers and more particularly to a self-contained doorbell controller having the capability to record and playback audio messages by means of a wireless intercom system.

BACKGROUND OF THE INVENTION

In the past a doorbell switch, annunciator, and chime device included a case having a lower window for displaying a name card, an upper window for displaying messages, and a doorbell pushbutton switch located between them. A dial was provided around the pushbutton switch; the dial was manually set to identify the expected return time of an absent occupant. Lamps were positioned behind the upper slot for illuminating a photographic film positioned in the upper slot. The photographic film contained the messages the occupant desired to display. The lower slot was designed to receive a name card for display. A two-way switch was connected between the pushbutton switch, lights, and chime. The switch could be thrown to a first position to connect the lights to a source of power to illuminate the message and to break the doorbell circuit and to a second position to turn off the lights and connect the doorbell. Those persons skilled in the art desiring more information of this prior art device are referred to U.S. Pat. No. 2,343,009 issued Feb. 29, 1944 to J. A. Hall.

Another prior art device included a musical door chime connected to a clock for annunciating the time. The device includes a read only memory (ROM) for storing a repertoire of musical tunes, one of which is displayed when a doorbell pushbutton switch is pressed. The tune to be played is selected by a keyboard connected to a microprocessor. The microprocessor reads from memory each digitally-encoded musical note for a note strike and decay circuit. This circuit converts the digital note to analog signals for energizing a loudspeaker. In addition, a clock generates the time for the microprocessor to automatically ring the chimes to indicate the hour of the day. Those persons skilled in the art desiring more information for this device are referred to U.S. Pat. No. 4,326,276 issued Apr. 20, 1982 to W. M. Scott, Jr.

Other prior art doorbell devices of interest includes a door signal regulator circuit which rings the bell at a constant rate regardless of whether the pushbutton is depressed only momentarily or for a long period of time (U.S. Pat. No. 2,909,771 issued Oct. 20, 1959). Another doorbell with hour-of-return indicator, includes a doorbell enabling switch and two dials (hours and minutes) concentrically mounted about the pushbutton switch for setting and lighting the time of return in a window when the doorbell is cut off and enabling the doorbell when non-lettered spaces of the dials are positioned in the window. Still another door signal device includes a key-controlled lock switch to provide a visual indication when the occupant is absent and has locked his door. The doorbell is cut off when the door is locked (U.S. Pat. No. 2,039,975 issued May 5, 1936).

Major differences between the prior art devices and the present invention exist. The programmable doorbell control device of the present invention is a low power device connectable to existing household wiring. In the alternative, the programmable doorbell control may be self-contained and powered by a conventional battery power source. The device has automatic and manual modes of operation. The automatic mode provides a means of disabling and re-enabling the doorbell by programming the device to perform these functions at a specified time, if desired. When disabled, the programmable doorbell control will display a selected one of a plurality of messages and sound an audible tone when the doorbell button is pressed in order to direct the visitor's attention to the displayed message. When desired, the manual mode is selected to override the automatic operation mode. In addition, the device continuously displays the name of the party occupying the home.

Thus, a visitor pushing a doorbell button hears a tone directing his attention to the display for receiving a message. A repertoire of messages including a PLEASE KNOCK message to localize the sound when an occupant such as, for example, a baby is sleeping and not to be disturbed; or if the occupant is a daytime sleeper, a DAYTIME SLEEPER message; or if the occupant does not want to be disturbed, a DO NOT DISTURB message can be displayed. These differences constitute features which are all advantages over the prior art.

However, the above described doorbell control is inconvenient if it is to be sold or used in several different countries where different languages are spoken. In this case, the messages which are displayed must be reprogrammed in each language before the device can be used. Accordingly, a second embodiment of the present invention is disclosed in which a recording and playback device is used to first record a message spoken by the user in his native language and, subsequently to playback the recorded message when the doorbell button is pushed. Similarly, the programmable doorbell control device of the present invention incorporates the capability for an occupant and/or visitor to record and playback an audible announcement or message by means of a speech controller integrated circuit and a wireless intercom system. Moreover, the recording and reproducing capabilities of the doorbell controller can be used either with or without an internal timer.

BRIEF SUMMARY AND OBJECTS OF THE INVENTION

In view of the foregoing, it is a primary object of the present invention to provide a low cost self-contained programmable doorbell control system.

Another object of the present invention is to provide a programmable doorbell control system having automatic and manual operational modes.

Yet another object of the present invention is to provide a programmable doorbell control system having an instructional information message display capability.

Still another object of the present invention is to provide a programmable doorbell control system which automatically disables and enables the doorbell at preselected times, if desired.

A further object of the present invention is to provide a programmable doorbell control system in which an audible announcement or message can be recorded by an occupant for playback when a doorbell actuation means is actuated.

Still a further object of the present invention is to provide a programmable doorbell control system in which audible messages can be recorded and played back using low cost circuitry.

Additionally, it is an object of the present invention to provide a programmable doorbell control system which is capable of transmitting an audible announcement or message spoken by an occupant or a visitor by means of a wireless intercom system.

Consistent with the foregoing objects, and in accordance with the invention as embodied and broadly described herein, a programmable doorbell controller is disclosed in one preferred embodiment of the present invention as providing a programmable doorbell control for either automatically or manually controlling the operation of a doorbell depending upon the positioning of a mode selection switch.

In the automatic mode, a controller interfaces with the operator, keeps the time of day, controls the enabling and disabling of the doorbell, controls a tone generator, and controls a display or audible communication means. In one preferred embodiment of the present invention, the occupant enters his name, selects a message for display, sets the clock to the current time of day, and sets the times for enabling and disabling the doorbell. When the doorbell actuation means, preferably a pushbutton switch, is actuated or depressed, the tone generator generates a tone for directing a visitor's attention to the display and the display displays an informational message selected from a repertoire thereof. In addition thereto, the name of the house occupant is continuously displayed on the display.

In the manual mode, the internal system operations of the doorbell controller are bypassed and control of the doorbell is returned directly to the doorbell actuation switch.

In the second embodiment, an audible announcement is recorded using digital technology. In particular, the occupant records a message by speaking into a microphone. The analog signals generated by the microphone are encoded into digital signals by means of a speech encoding integrated circuit. The resulting digital signals are stored in an integrated circuit memory. Later, when the doorbell is pushed the stored digital signals are retrieved from the memory and provided to an integrated circuit speech synthesizer which generates audio analog signals. The audio signals are amplified and used to drive a speaker which generates a reproduction of the audible announcement or message.

In an alternate embodiment of the present invention, an audible announcement is recorded and stored by a doorbell control module using speech controller integrated circuitry. In particular, the occupant records a message or announcement by speaking into a microphone housed within a doorbell control module. Analog electrical signals are generated by a microphone and encoded by the speech controller integrated circuit for storage by a microcomputer on a speech chip. Later when the doorbell actuation means is actuated by a visitor, stored analog electrical signals are retrieved from the internal memory of the microcomputer and processed by the speech controller integrated circuit, thus generating an output of audio analog signals. Accordingly, the output audio signals are amplified and used to drive a loudspeaker to produce an audible reproduction of the message or audible announcement recorded by an occupant.

As a variation of the alternate embodiment generally described above, the programmable doorbell control of the present invention includes a self-contained remote module which interfaces with the doorbell control module by means of a wireless intercom system. When the doorbell actuation means, preferably formed on the facing of the remote module, is actuated or depressed by a visitor, the remote module simultaneously transmits a tone or signal which can be received and detected by the doorbell control module, preferably positioned within the premises of the building or home. In response, the doorbell control module activates its internal speech controller integrated circuit and internal components to generate a playback of the stored audible announcement previously recorded by the occupant. Similarly, a visitor can easily respond to an occupant's audible announcement or message by actuating or depressing a recording actuation means of the remote module to activate a microphone to generate a responsive audible announcement or message which can be transmitted by means of the wireless intercom system to the control module for encoding and storage. In this manner, the visitor's audible announcement or message is encoded, recorded and stored by the speech controller integrated circuitry of the control module for playback by the occupant.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through the use of the accompanying drawings in which:

DETAILED DESCRIPTION OF PREFERRED EMBODIMENTS

Figure 1:
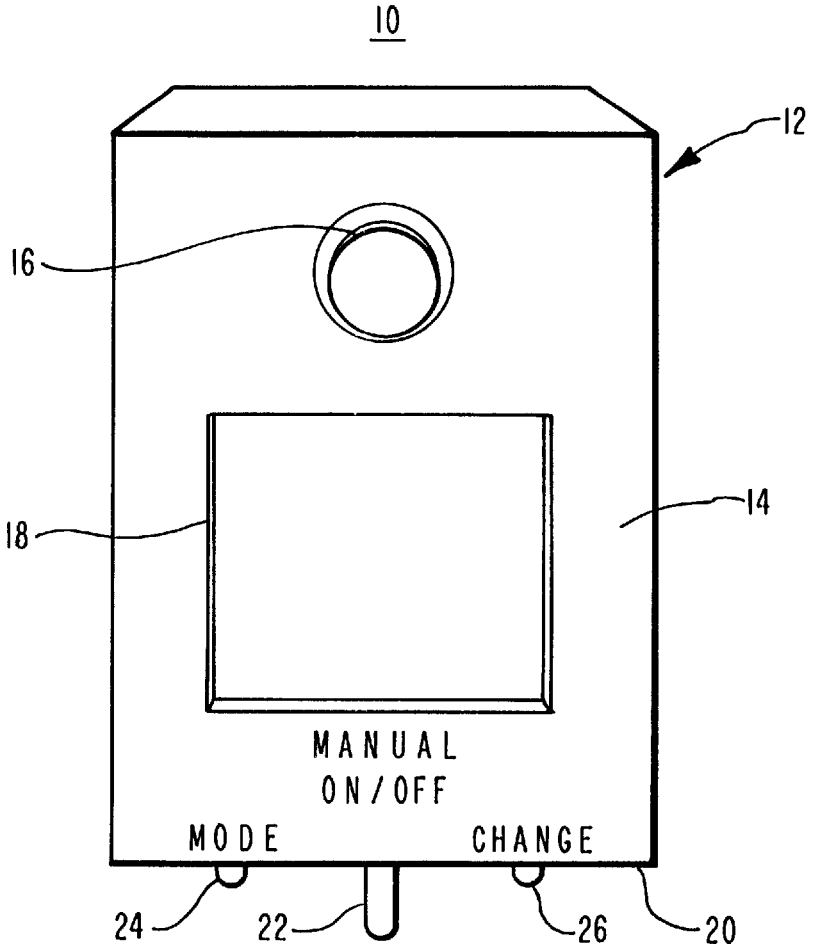
FIG. 1 is an isometric view of a programmable doorbell control device illustrating one presently preferred embodiment of the present invention.

It will be readily understood that the components of the present invention, as generally described and illustrated in the Figures herein, could be arranged and designed in a wide variety of different configurations. Thus, the following more detailed description of the embodiments of the system and method of the present invention, as represented in FIGS. 1 through 8, is not intended to limit the scope of the invention, as claimed, but it is merely representative of the presently preferred embodiments of the invention.

The programmable doorbell control device 10 (FIG. 1) includes a housing 12 having a front panel 14. The front panel includes a doorbell actuation means 16 and a display 18 such as, for example, a liquid crystal display or any other conventional display means. As illustrated herein, the doorbell actuation means 16 of the presently preferred embodiment incorporates a pushbutton switch. It will be readily appreciated, however, that other types of suitable doorbell actuation means 16, such as, for example, a pressure sensitive switch, a touch sensitive switch, a slide switch, a momentary or non-momentary switch, a pressure sensitive floor mat, an infrared beam, etc. are possible. In one preferred embodiment of the present invention, the housing 12 has a bottom 20 having mounted therein multiple control switches including, for example, a switch 22 for selecting either the automatic or manual operation mode, an enable/disable mode switch 24 and a change switch 26. Preferably, the enable/disable mode and change switches 24 and 26 are conventional pushbutton switches for setting and changing the operational parameters of the programmable doorbell device 10. It will be readily appreciated, however, that other suitable forms of mode switch 24 and/or change switch 26, such as, for example, a pressure-sensitive switch, a slide switch, a toggle switch, etc. are readily possible. The housing 12 houses the internal circuitry including the electronic circuitry for the programmable doorbell device 10.

The electronic circuitry 28 (FIG.2) for the solid state programmable doorbell device 10 includes a power source 30 connected by leads 32 and 33 for supplying power to a controller 34, liquid crystal display (LCD) 18 and tone generator 36. The power source 30 is separate from the house power supply. Preferably, the power source 30 comprises a small, inexpensive watch battery; thus, existing electric doorbell switches are replaced without requiring the expertise and expense of an electrician or any change in the house wiring. It will be appreciated, however, that those skilled in the art will readily recognize that other suitable power sources which are consistent with the spirit and scope of the present invention are possible. The control switches, including enable/disable mode switch 24, change switch 26 and manual switch 22 are typical state-of-the-art switches connected to the controller for purposes hereinafter described. The control switches provide a short pulse to a detection circuit. Debouncing circuitry is in the controller to minimize the external component count and to simplify the manufacturing process.

The controller 34 is preferably connected by bus 42 to the LCD display which includes the display drivers. The LCD display bus 42 includes an 8-bit data bus, a 4-bit address (character select) bus, a strobe signal line to synchronize communication between the display and the display control circuit and a blink line which, when active high, causes the character being sent to be blinked on the display. In the preferred embodiment, it is not necessary for the display to get data for the messages from the display control circuit; all that is needed is a pointer directing the display to the correct message.

The display 18 is a three-segment LCD display of typical LCD display construction. The display includes a twelve-character display segment for the occupant's name and two seven-character display segments for the information message to be displayed. The controller 34 is also connected by leads 44 and 46, respectively, to the tone generator 36 and doorbell control circuit 48 for control purposes.

The tone generator is a typical tone generator including an oscillator and transducer. When the tone strobe output of the controller becomes active, the oscillator will engage and provide a short tone burst to the transducer for generating an audible frequency suitable for signalling purposes. The doorbell control circuit 48 includes a electronic switch, such as, for example, a TRIAC having its gate connected to a bell enable control output of the controller. The TRIAC controls the application of household power to a suitable electric doorbell 50 connected in series therewith. Thus, if the doorbell enable signal is active and the doorbell pushbutton switch 16 is pressed, the doorbell will ring in the house; otherwise, if the doorbell enable signal is not active and the doorbell pushbutton switch 16 is pressed, the doorbell will not ring.

Figure 3:
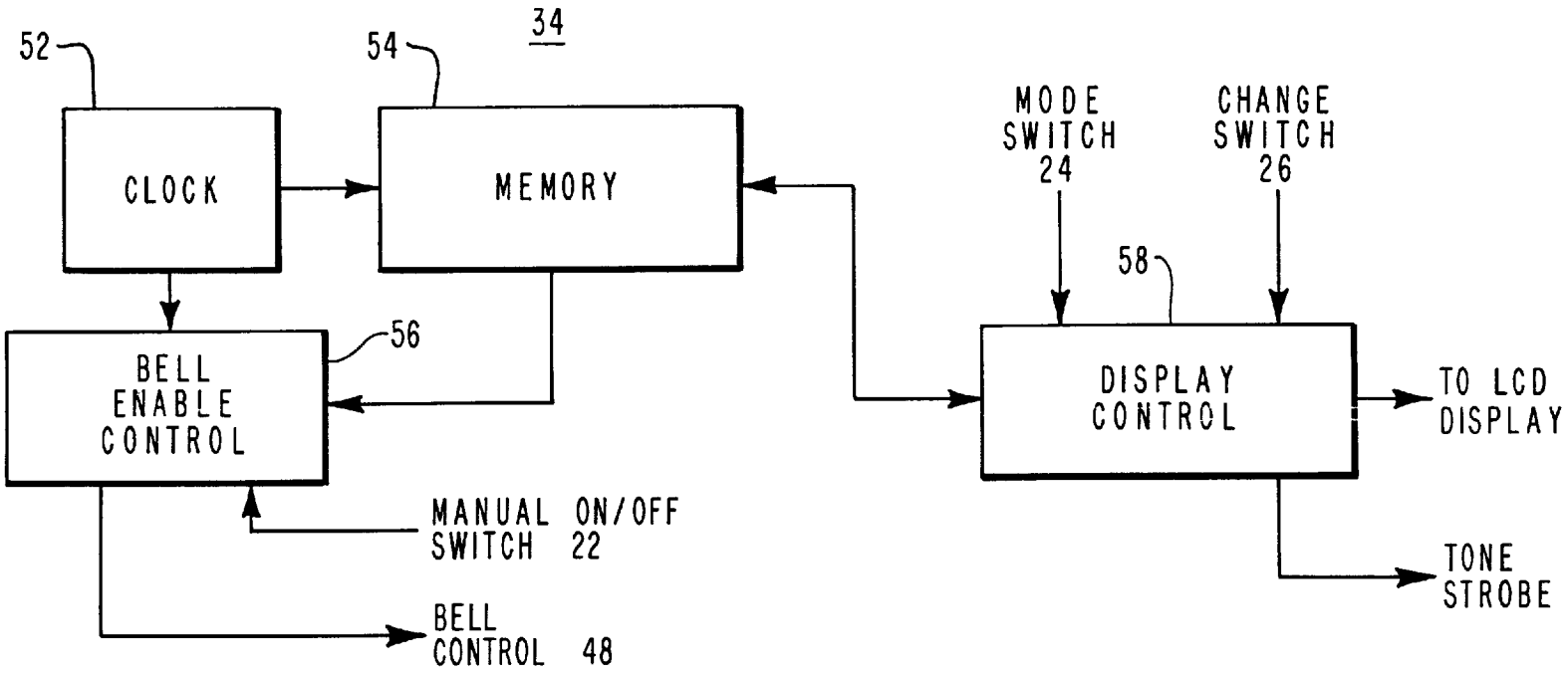
FIG. 3 is a block schematic diagram illustrating one presently preferred configuration of the controller of one presently preferred embodiment of the programmable doorbell control.

Referring now to FIG. 3, the controller 34 includes a clock 52 connected to a memory 54 and a doorbell enable control circuit 56. The memory 54 is connected to a display control 58 and to the doorbell enable control circuit 56. The doorbell enable control circuit 56 is connected to the manual on/off switch 22 and to the doorbell control circuit 48. The display control 58 is connected to the enable/disable mode switch 24 and change switch 26 and outputs control signals to the LCD display 18 and tone strobe signals to the tone generator.

In one preferred embodiment, the function of the clock 52 is to fetch the present time of day from memory, wait approximately one minute and write the new time back to the time of day register in memory 54. The clock includes an oscillator and a counter (not shown). Once the correct count is observed at the counter output, preferably a minute has expired causing the memory to be updated with the new time.

The memory 54 stores all of the programmed information. The only parameter which will be altered once the device is programmed is a time of day which changes by the minute.

The display control 58 supplies the custom LCD display 18 with the data to be displayed in the twelve character name display. The display 18 (FIG. 2) is used while programming in order to prompt the operator for the required parameters and it also displays the house occupant's name during normal operation. Thus, the data displayed in this segment of the display is changed depending upon the operation mode.

In operation, the display control 58 (FIG.3) of the preferred embodiment provides the LCD 18 with a stream of 12 one byte ASCII coded characters, a 4-bit decoding nibble, a strobe pulse and a blink character signal. The display control circuit also provides the display 18 with a 2-bit disable message select signal.

Figure 2:
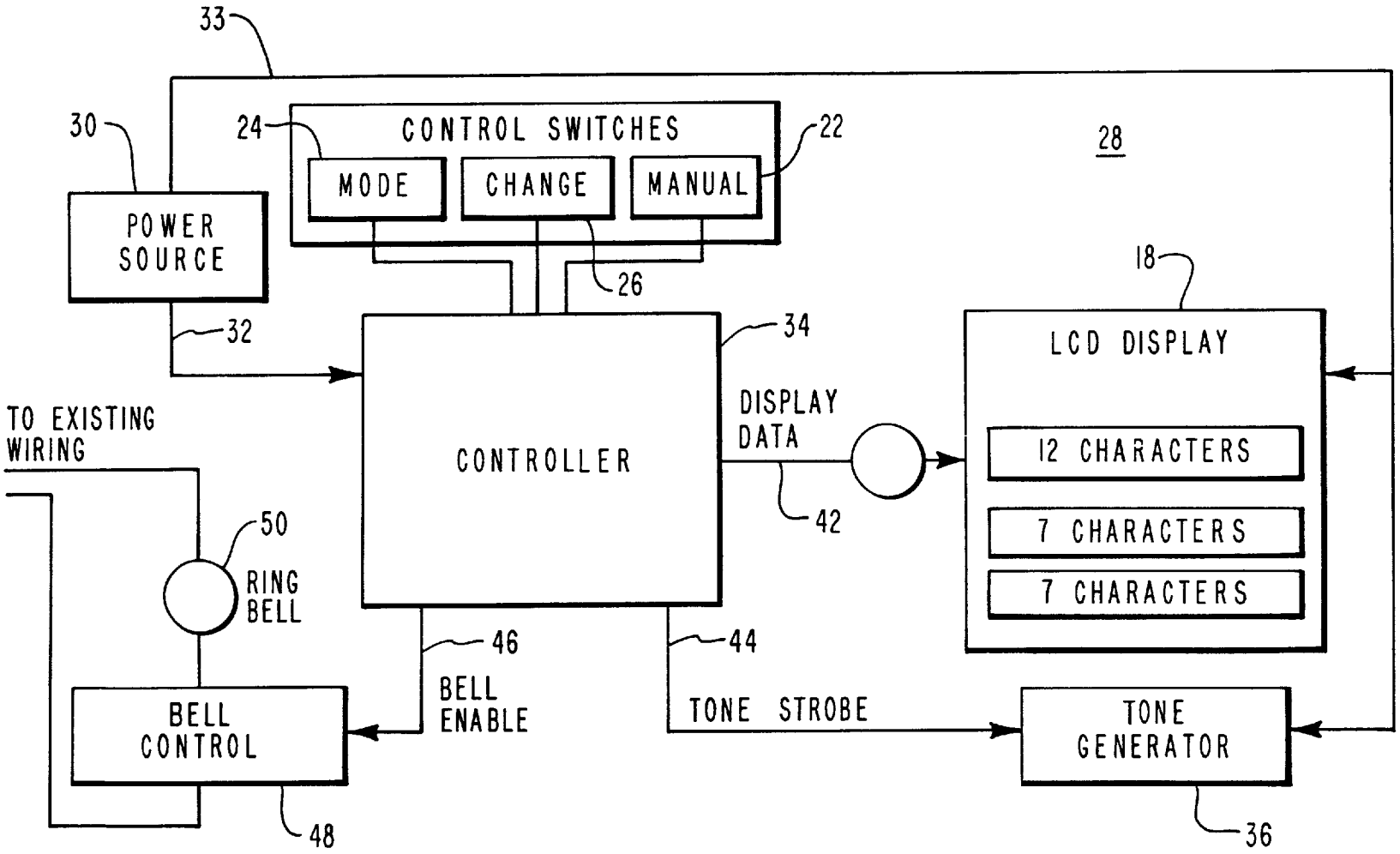
FIG. 2 is a block schematic diagram illustrating one presently preferred representation of the programmable doorbell control circuit of one presently preferred embodiment of the programmable doorbell control.

The display control 58 interfaces with the operator through the enable/disable mode and change switches 24 and 26 (FIG. 2). The display control circuit (FIG. 3) detects the actuation of the enable/disable mode switch 24 and increments the parameter in memory 54 pointed to by an address counter to the next value each time the change switch 26 is actuated or pressed. The display control circuit enters the normal operation mode when the last parameter is entered and the enable/disable mode switch 24 is actuated. In the normal operation mode, the name of the occupant and selected message to be displayed are sent to the LCD display 18.

The doorbell enable control circuit 56 fetches the doorbell disable time and the time of day from memory 54, compares them and determines if the doorbell should be disabled. Once disable, the doorbell enable control circuit 56 fetches the enable time and the time of day and compares those to determine if the doorbell should again be enabled. Thus, the circuit will provide the doorbell control 48 (FIG.2) with an active "high" signal at the doorbell enable output when the doorbell is enabled, and an inactive "low" signal when the doorbell is disabled. The doorbell control circuit 56 also monitors the manual on/off switch 22; while in the manual "on" position, all other functions of the doorbell enable control circuit 56 are disabled.

FLOWCHART

The programming of the controller is described in connection with a flowchart (FIG. 4) as follows.

At start 100, with the doorbell in normal operation, to set or correct the clock's time of day, a decision 102 is made whether the mode switch has been pressed and the hours display blinking; else a manual on/off switch subroutine beginning with decision 140 is entered. If decision 102 is yes, a decision 104 is made whether the change switch has been pressed and the hour entered; if yes, a decision 106 is made whether the mode switch has been pressed again, else the decision 106 is made directly whether the mode switch has been pressed again. When decision 106 is yes, a decision 108 is made whether the change switch has been pressed and minutes entered; if yes, a decision 110 is made whether the mode switch has been pressed, a "DISABLE" message displayed and hours flashing; else decision 110 is made directly.

When decision 110 is yes, the mode switch has been pressed again, a "DISABLE" message displayed and the disable hour display blinking, a decision 112 is made whether the change switch has been pressed and the disable hour entered; if yes, a decision 114 is made whether the mode switch has been pressed, the "DISABLE" message displayed and the disable minutes display blinking, else the decision 114 is made directly. When decision 114 is yes, a decision 116 is made whether the change switch has been pressed and the disable minutes entered; if yes, decision 118 is made whether the mode key has been pressed and "ENABLE" message displayed and the enable hours display blinking, else decision 118 is made directly.

When decision 118 is yes, the mode key has been pressed and the enable hours display is blinking, a decision 120 is made whether the change switch has been pressed and enable hours entered; if yes, a decision 122 is made whether the mode key has been pressed, the "ENABLE" message displayed and the enable minutes display blinking, else decision 122 is made directly. When decision 122 is yes, a decision 124 is made whether the change switch has been pressed and the enable minutes entered; if yes, a decision 126 is made whether the mode switch has been pressed, a "MESSAGE" message displayed and the disabled message display blinking, else the decision 126 is made directly. When decision 126 is yes, a decision 128 is made whether the change key has been pressed and the disable message selected; if yes, a decision 130 is made whether the mode switch has been pressed and the first letter of the name display blinking; else decision 130 is made directly.

When decision 130 is yes, a decision 132 is made whether the change key has been pressed and a first letter entered. If decision 132 is yes, a decision 134 is made whether the mode switch has been pressed and the next letter position blinking; else decision 134 is made directly. If decision 134 is yes, a decision 136 is made whether the change key has been pressed and the next letter entered. When decision 136 is yes, a decision 138 is made whether the mode key has been pressed and the last position entered; else decision 138 is made directly. When decision 138 is yes, return is made to start, else return is made to step 134 and steps 134, 136 and 138 repeated until decision 138 is yes and return is made to start (normal operation).

Returning now to decision 140, the manual on/off switch subroutine begins with the decision 140 as to whether the manual on/off switch is in the "on" position; if yes, an instruction 142 is issued to override the mode, disable doorbell, and display selected message; else an instruction 144 is issued to return to start 100. After instruction 142 is issued a decision 146 is continuously made to determine whether the manual on/off switch has been pressed again; if yes, return is made to start, else the decision 146 is continuously made until the decision is yes and return is made to start for normal operation.

It will be appreciated by those skilled in the art that the foregoing logic flowchart can be implemented using state-of-the-art gate array technology. Thus, with the clock set to the correct time, the doorbell disable time and enable time entered correctly, the occupant's name entered and the message to be displayed selected, the programmable doorbell controller is ready for operation.

In operation, when a visitor arrives, he finds the occupant's name displayed on the LCD display 18 to ensure he is at the correct address. When the visitor presses the doorbell pushbutton switch 16, a tone will direct attention to the LCD message display 18. If the visitor has arrived during the time the doorbell is disabled, the message will advise the visitor whether to knock on the door, to not disturb the occupant, or that the occupant is a daytime sleeper. These messages, though typical, are examples only and these and additional or other messages can be programmed into the doorbell control system at the factory level. In a more sophisticated embodiment of the present invention, the occupant can enter desired messages in the same manner as the occupant's name is entered. Should the occupant, for any reason, desire normal operation during the disable period, the manual on/off switch can be actuated or pressed to override the controller. Automatic control is again established by actuating the manual on/off switch once again.

Figure 4A:
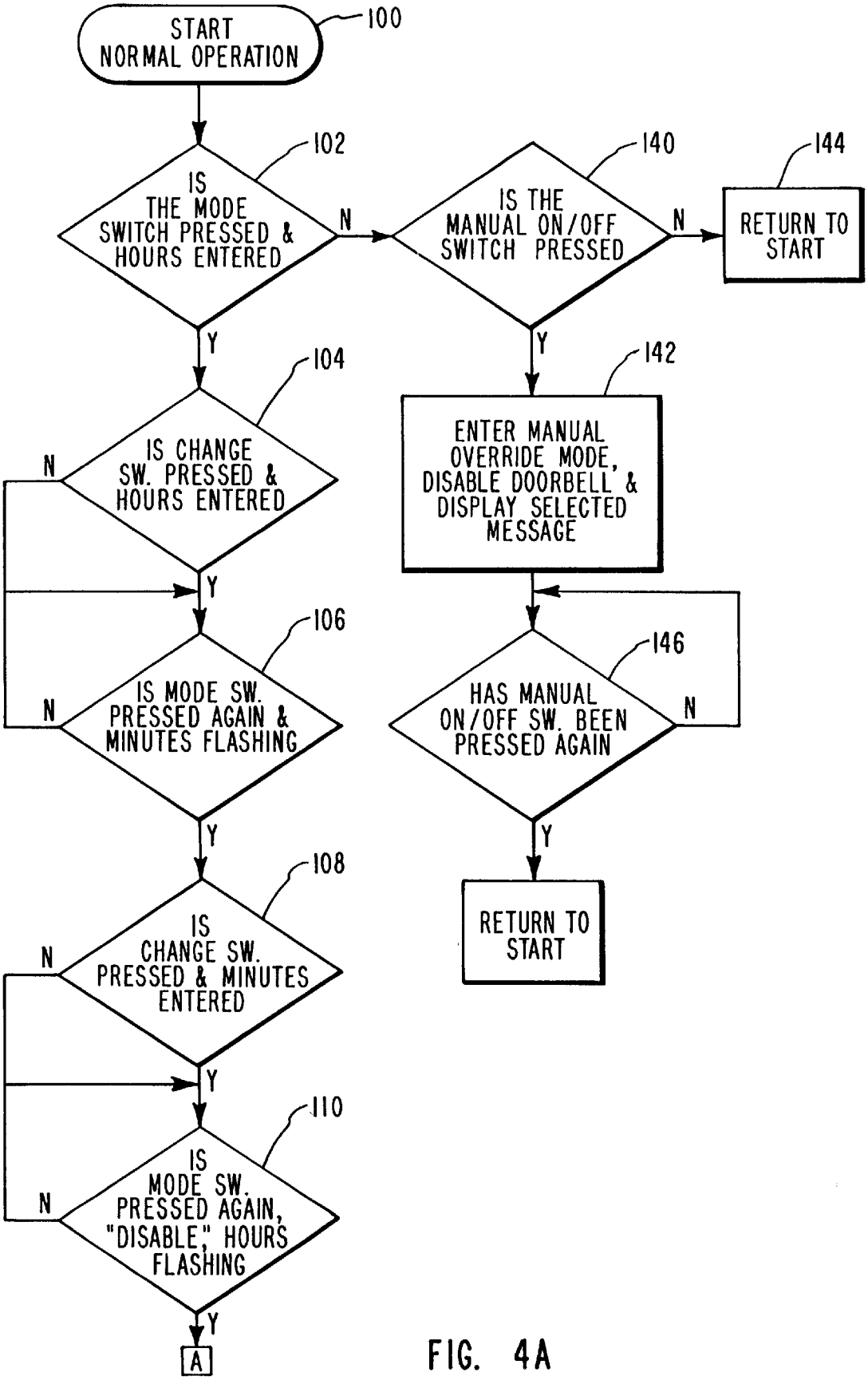
FIG. 4 is a flowchart illustrating one presently preferred representation of the logic flow of one presently preferred embodiment for setting the operational parameters of the programmable doorbell control.
Figure 4B:
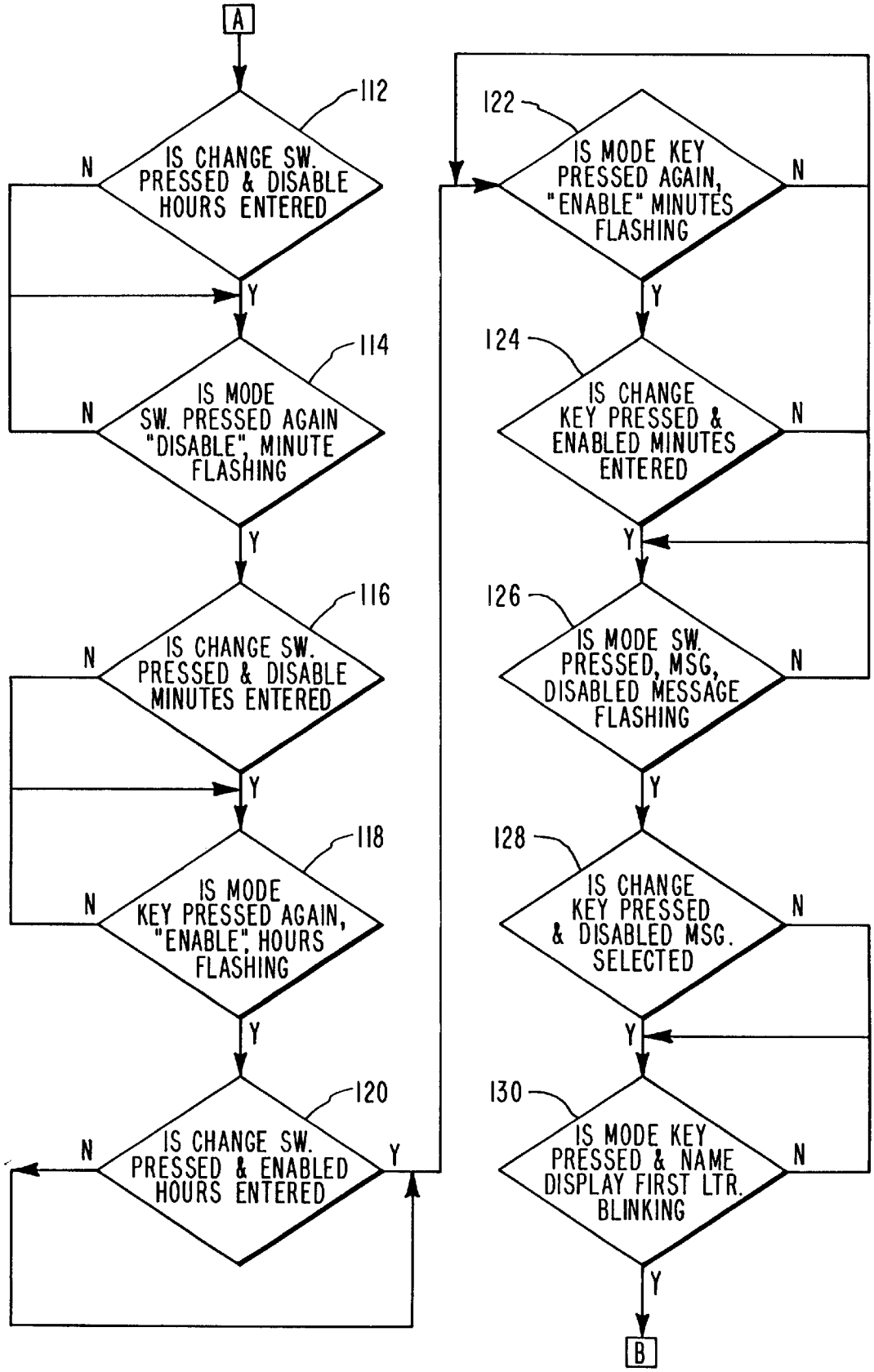
Figure 4C:
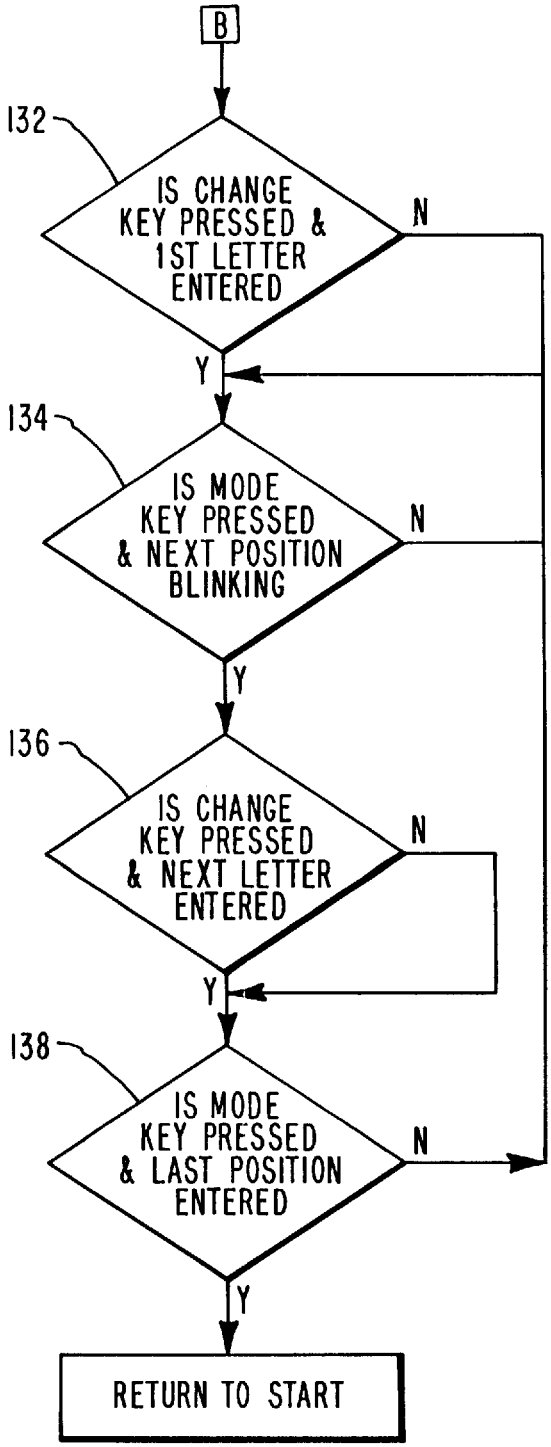

Those of ordinary skill in the art will, of course, appreciate that various modifications to the logic flow diagram of FIG. 4 may be easily made without departing from the essential characteristics of the invention, as described herein. Thus, the detailed logic flowchart of FIG. 4 is intended only as an example, and it simply illustrates one presently preferred embodiment of a logic flowchart that is consistent with the invention as disclosed and claimed herein.

Figure 5:
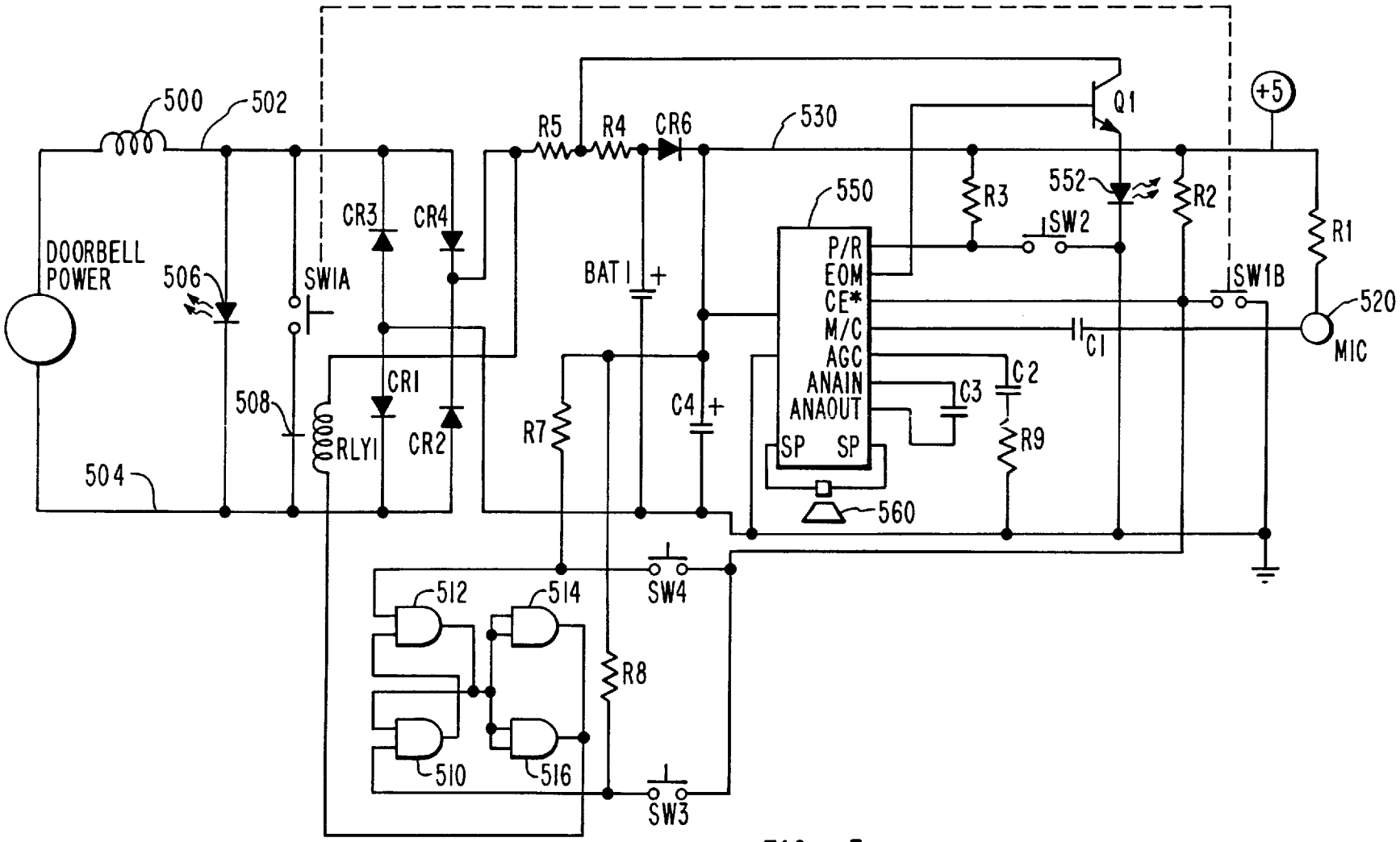
FIG. 5 is a circuit schematic diagram illustrating one presently preferred configuration of an electrical circuit for recording and generating an audible announcement of one presently preferred embodiment of the programmable doorbell control.

A circuit diagram representing a presently preferred configuration of the electrical circuitry for recording and generating an audible announcement of the present invention is shown in FIG. 5. This embodiment has the advantage that the occupant can "program" a message by speaking into a microphone to generate a stored message. The stored message is later played back when the doorbell switch is pressed. Thus, this embodiment can be sold or used in various countries where different languages are spoken. Since there is no preprogrammed message, exactly the same circuitry can be used in all languages. Although the alternate embodiment shown in FIG. 5 does not include a timer, the speech storage and retrieval circuitry disclosed can be used in place of the message display 18 and tone generator 36 shown in FIG. 2 of the previous embodiment. If, however, an internal system clock or timer is used in correlation with the speech storage and retrieval circuitry of the present invention, the operational parameters of the programmable doorbell control 10 would comply with substantially the same logic flow diagram as set forth in FIG. 4, with the exception that a message would not be selected from a repertoire of messages for display on an LCD display pursuant to decisions 126, 128 and 142. Rather, this alternate embodiment of the programmable doorbell control 10 would provide means for enabling speech controller integrated circuitry to record and playback an audible announcement generated by an occupant when the doorbell actuation means 16, preferably a pushbutton switch, is actuated by a visitor.

As shown in FIG. 5, electrical power is applied to the electronic doorbell from the existing house AC or DC power supply through existing house doorbell wiring. Doorbell power supplies in various areas may be AC or DC voltage of varying magnitude and the existing wiring may have variable current carrying capacity. In addition, normal operation of the doorbell pushbutton switch operates existing doorbell 500 by shorting existing wires 502 and 504 together. This short circuit removes power from the doorbell circuit when the speech storage and retrieval circuitry needs power to record or playback audible messages. Accordingly, the illustrative embodiment generates an internal DC voltage which is stabilized by an internal battery power source. Thus, the illustrative programmable doorbell control can operate with virtually any voltage and wiring. Preferably, the internal battery power source comprises a watch battery, such as, for example, a nickel cadmium battery, however, any other conventional battery power source is readily possible.

In an alternate embodiment of the present invention, electrical power is supplied to the programmable doorbell control from a stand-alone battery power source without requiring a direct wiring interface between the doorbell controller and the existing house doorbell wiring. In this regard, the battery power source generates sufficient power to the programmable doorbell control to power its integrated circuitry and internal components thereby facilitating a self-contained electronic doorbell system.

In particular, incoming electrical power (either AC or DC) is rectified to generate DC power by diodes CR1-CR4 which are connected as a full-wave bridge rectifier. Due to the rectifier circuit, even if the doorbell is connected to DC power, it is impossible to connect it with improper polarity. Assuming that the existing house power is AC, the pulsing DC power generated by diode bridge CR1-CR4 is clipped to a predetermined voltage level by resistor R5 and Zener diode CR5. Preferably, the clipped voltage is used to continuously trickle charge a nickel cadmium battery BATl through resistor R4. Resistor R4 is set to provide a current of 1/100of the battery capacity, to allow for continuous charging. The resulting voltage is a regulated voltage that will always be available. The regulated voltage is reduced to a final value by series-connected diode CR6. The resulting final voltage on line 530 is then used as needed to power the electronic doorbell circuits.

For convenience, a light emitting diode (LED) 506 is connected across wires 502 and 504. The small current which flows through, and activates, LED 506 is not sufficient to activate doorbell 500, but LED 506 illuminates the doorbell pushbutton switch SWlB. When switch SWIB is pressed, the LED 506 will be shorted by switch SWlB and LED 506 will go out. The higher current flow through switch SWlB, wires 502 and 504 and relay contact 508 activates doorbell 500. This operation is substantially identical to conventional illuminated, mechanical doorbell buttons.

Relay RLY1 is used to silence existing bell 500 when desired by the occupant. Relay is an AC relay powered by the unregulated pulsing DC output of rectifier bridge CR1-CR4. In order to silence bell 500, the occupant presses the doorbell button. The doorbell button closes switches SWLA and SWLB which are mechanically ganged together. Simultaneously, the occupant momentarily presses either pushbutton switch SW4 (BELL ON) or switch SW3 (BELL OFF).

When switch SW3 has been pressed to silence bell 500, a "low" ground signal passes through closed switch SWLA and closed switch SW3 and is applied to one input of NAND gate 510. The output of NAND gate 510 immediately becomes "high" in response. This "high" signal is provided to one input of NAND gate 512 and, in conjunction with a "high" present at the other input of NAND gate 512 forces its output "low". This "low" output is thereupon provided to one input of NAND gate 510 and holds its output "high" even when the doorbell buttons are released. NAND gates 510 and 512 thus act as a flip flop memory circuit.

The "low" output of NAND gate 512 is provided to NAND gates 514 and 516 which act as buffers in order to generate a higher current output to drive relay RLY1. In response to the "low" input, gates 514 and 516 generate a "high" output which prevents relay RLY1 from operating. Since relay RLY1 has a normally open contact 508 in series with doorbell switch SWLB, current cannot flow to doorbell 500 when a visitor later presses the doorbell switch SWlB.

In order to allow doorbell 500 to operate when switch SWlB is pressed, the occupant simultaneously presses switches SWLA and SW4. A "low" ground signal is applied to the upper input of NAND gate 512 via switch SWLA and SW4. The output of NAND gate 512 immediately goes "high" in response. This "high" signal is applied to the upper input of NAND gate 510 and, in conjunction with the "high" signal at the lower input of NAND gate 510 forces the output of NAND gate 510 "low", thus resetting the flip flop. A "high" signal at the output of NAND gate 512 is inverted by NAND gates 514 and 516 and applied as a "low" signal to relay RLY1. This "low" signal activates relay RLYe, closing its normally open contact 508 and allows current to flow when a visitor presses the doorbell witch SWLB.

Referring to one presently preferred embodiment of the present invention, in order to record, store and playback messages, a spoken message is processed by integrated circuitry of the programmable doorbell control which first is converts the audio message into digital signals. The digital signals can then be stored in an inexpensive digital memory until playback. During playback the stored digital signals are used to drive a speech synthesizer which generates an audio playback announcement. Those skilled in the art will readily recognize other possible modifications and adaptations for storing and converting audible announcements which are consistent with the spirit and scope of the present invention, such as, for example, using an ISD chip rather than the speech synthesizer of the present embodiment to generate a recording, storage and playback of an audible announcement.

Figure 6:
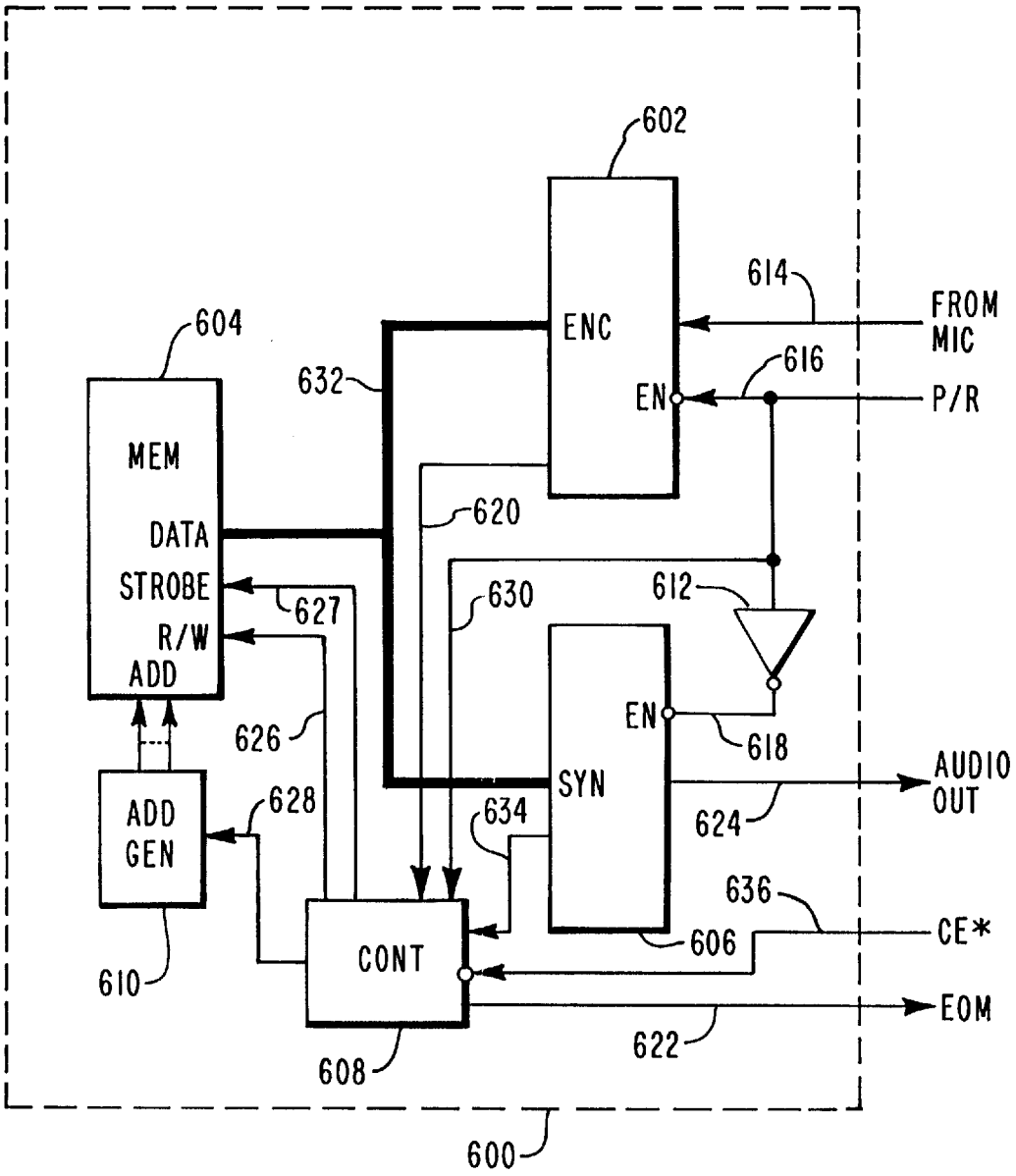
FIG. 6 is a block schematic diagram illustrating one presently preferred representation of the speech recording and playback circuitry of one presently preferred embodiment of the programmable doorbell control.

The general arrangement of the digital circuitry of one presently preferred embodiment is shown in block diagram form in FIG. 6. The record and playback circuitry 600 consists of speech encoder circuit 602, digital memory 604, speech synthesizer 606, control circuit 608 and address generator 610. The playback and record mode of the circuit is controlled by the signal on the Playback/Record (P/R) line 616. A "low" signal on this line places the circuit in "record" mode and a "high" signal on Line P/R places the circuit in the "playback" mode.

In the "record" mode, a "low" signal on line 616 is applied to the enable input EN of the speech encoder circuit which "low" signal enables the chip. The "low" signal on line 616 is also inverted by inverter 612 and applied as a "high" signal to disable speech synthesizer circuit 606 which is used during the playback mode of operation. The "low" signal is further applied to the control circuit 608, via line 630, which "low" signal informs control circuit 608 that record mode is desired.

Recording is actually initiated by a "low" signal received on the chip enable CE* line 636. In response thereto, control circuit 608 places a signal on line 626 which signal is applied to the read/write (R/W) input of memory 604 causing the memory to be placed in a write mode. Control circuit 608 also controls address generator 610 to generate address signals which are applied to the memory address inputs of memory 604 and applies a "high" signal on the end-of-message line (EOM) 622 to indicate that recording has started.

Speech encoder 602 receives analog audio signals on line 614 from a microphone (not shown in FIG. 6). Encoder 602 samples the audio signals and generates a digital word on data bus 632 which provides the digital signals to the data inputs of memory 604. Although bus 632 is shown as a single heavy line, typically it would consist of a plurality of signal lines since the digital words generated by encoder 602 have multiple bits. When encoder 602 has placed a digital word on data bus 632 it signals control circuit 608 via line 620.

In response to the signals from encoder 602, control circuit pulses memory strobe line 627 causing the digital word on bus 632 to be stored in memory 604 at the address generated by address generator 610. Control circuit 608 then controls address generator 610 to generate another address for the next digital word.

Operation continues in this manner with encoder 602 generating digital words which are sequentially stored in memory 604 until memory 604 is full or the "low" signal on playback record line 616 is removed. When either of the latter two conditions occurs, speech conversion is ended and control circuit places a "low" signal on the end-of-message EOM line 622 as a signal that recording has been completed. If the memory 604 is not full when recording is finished, control circuit 608 generates an "end-of-message" signal which is recorded in memory 604 to mark the last digital word.

During playback operation, a "high" signal is placed on the playback/record line 616. This "high" signal is provided to the enable input of encoder circuit 602 to disable the circuit. The "high" signal on line 616 is also inverted by the inverter 612 and applied as a "low" signal to the enable input (EN) of speech synthesizer circuit 606 to enable the circuit. The "high" signal is also applied, via line 630, to control circuit 608 to place the control circuit in the playback mode. As with recording, playback is initiated by a "low" signal received at the chip enable input CE*.

In the playback mode, control circuit 608 places a signal on line 626 which signal is applied to the read/write input (R/W) of memory 604 to place the memory in a read state. Control circuit 608 also controls address generator 610 to generate address signals for retrieving the first digital word. Control circuit 608 then pulses strobe line 627, causing memory 604 to place the stored digital word at the location indicated by the address signals onto data bus 632.

The digital signals on bus 632 are applied to speech synthesizer 606. In response to these signals synthesizer 606 generates corresponding audio signals on the AUDIO OUT line 624. When conversion of the digital signals is complete, synthesizer 606 signals control circuit 608 via line 634. Control circuit 608 thereupon controls address generator to generate the next address so that the next stored digital word can be retrieved from memory 604. Operation continues in this manner with sequential digital words being retrieved from memory 604 and converted to speech signals by synthesizer 606 until the entire message has been read out of memory 604 as indicated by reading the entire message out or by reading out the stored end-of-message marker.

The operation of the message recording the playback circuitry will not be discussed further herein because the construction and operation of the circuitry is conventional and well known. For example, an integrated circuit which includes the speech encoder, decoder and associated control circuitry is manufactured by Texas Instruments, Inc. located at P.O. Box 225012-MS-84, Dallas, Tex. under the model number TMS 3477. This latter circuit can be combined in a straightforward fashion with a digital memory to produce the illustrative playback and recording circuitry.

Alternatively, a preferred playback and record circuit consisting of all the components shown in FIG. 6 plus input and output audio amplifiers is sold as a single integrated circuit designated as an "Integrated Voice Recorder" (IVR) manufactured by Information Storage Devices, 2332B Walsh Avenue, Building G, Santa Clara, Calif. 95051. In the preferred embodiment discussed below the IVR circuit is described, but it should be understood that the above mentioned TMS 3477 circuit with an accompanying memory can be substituted in a straightforward manner.

Returning to FIG. 5, the record and playback sequence will be discussed. More specifically, in order to record a message which will be announced to a visitor when switches SWlB and SWlA are closed by pressing the doorbell button, the occupant simultaneously presses record pushbutton switch SW2 and the doorbell button which closes switch SWlA. While holding both switches closed, the occupant speaks into microphone 520. Microphone 520 connects from power line 530 to the microphone input MIC of circuit 550 through DC blocking capacitor Cl. The MIC input is connected to an internal audio amplifier whose output appears at the ANAOUT output. Capacitor C3 is used to connect the amplified analog signal to the ANAIN input of circuit 550 which is the input to the analog recording logic in circuit 550.

When closed, switch SW2 places a "low" on the playback/record (P/R) input of the record/playback circuit 550. As previously mentioned, the "low" signal places the playback/record circuit into a "playback" mode. Closed switch SWlA provides an "enable" signal to the chip enable input CE* of circuit 550 which, as previously described above, starts a recording operation.

As previously mentioned, circuit 550 places a "high" signal on the EOM end-of-message output when recording. The "high" signal of the EOM output is provided to transistor Qi via resistor R6. The "high" signal from the EOM output turns transistor Ql "on" allowing current to flow through Ql to LED 352, in turn, activating LED 552. The resulting light from LED 552 gives the occupant a visible indication that a recording is being made.

When the record switch SW2 or doorbell button SWIA is released by the occupant or the recording capacity of circuit 550 is exceeded, an end-of-message marker is recorded in circuit 550 and the EOM output becomes "low". Consequently LED 552 is deactivated. The occupant then knows that recording of the message is finished.

Subsequently when a visitor presses the doorbell switch, playback of the recorded announcement or message is initiated. More specifically, when a visitor presses the doorbell button, switches SWlA and SWlB are closed. Since the record switch SW2 is not pressed at this time, a "high" signal is provided via resistor R3 to the P/R input of circuit 550 to place it in the playback mode. Closed switch SWLA applies a "low" signal to the chip enable input CE* of circuit 550 which then activates the playback of the message as described above. The EOM output of circuit 550 will become "high" during playback, activating LED 552. When the message finishes playing, LED 552 will go off.

Resistor R2 and capacitor C2 make up an R/C network which is used to generate an automatic gain control voltage for circuit 550 if the aforementioned IVR circuit is used. As the occupant speaks louder during message recording, the gain of the input amplifier will be decreased. As the occupant speaks softer, the gain will be increased correspondingly.

For the aforementioned IVR circuit an output speaker 560 can be connected directly to speaker outputs SP.

Figure 7:
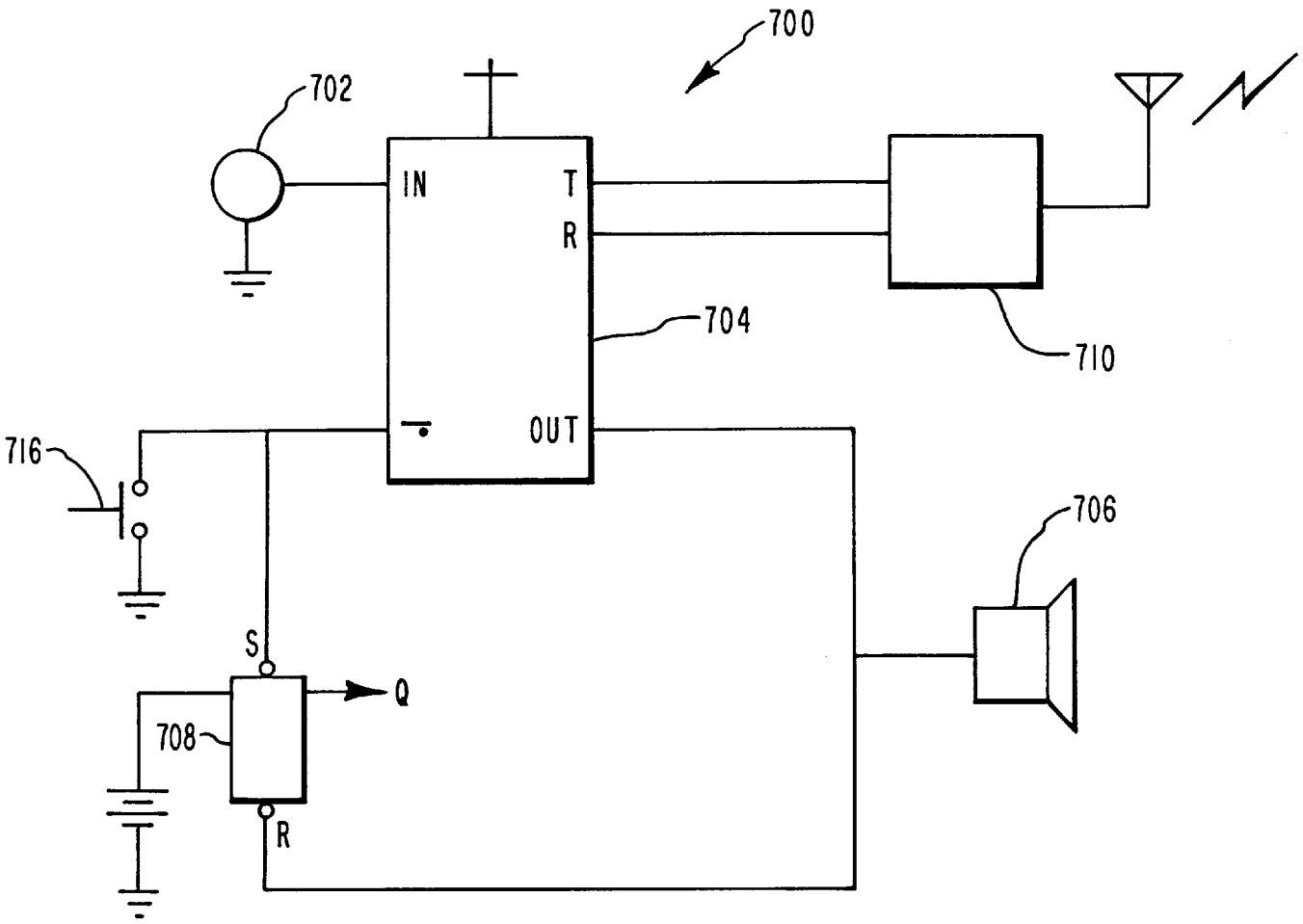
FIG. 7 is a block schematic diagram illustrating one presently preferred configuration of the remote module of one presently preferred embodiment of the programmable doorbell control.
Figure 8:
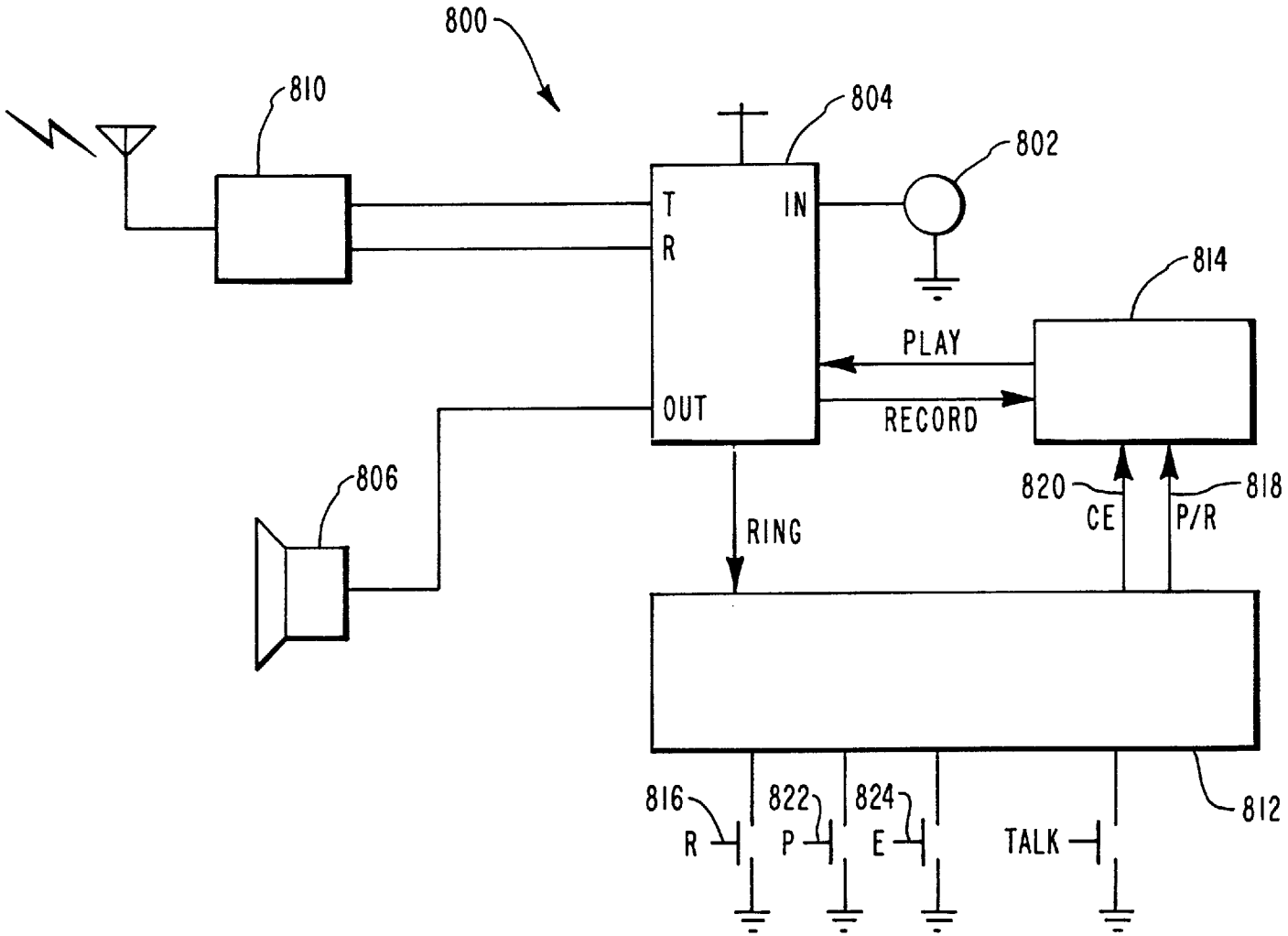
FIG. 8 is a block schematic diagram illustrating one presently preferred configuration of the control module of one presently preferred embodiment of the programmable doorbell control.

In addition to the foregoing, FIGS. 7 and 8 illustrate yet another alternate preferred embodiment of the programmable doorbell control. Provided as a variation of the preferred embodiment described in FIGS. 5 and 6, this alternate embodiment consists of at least two independent interactive modules which incorporate the ability to record and playback audible announcements or messages using speech controller integrated circuitry and transmit these audible announcements or messages between modules using a wireless intercom system. This embodiment has the similar advantage that the occupant of a building or home can "program" an announcement or message by speaking into a microphone to generate a stored message for playback at a later time when the doorbell actuation means is actuated as outlined above. In addition, however, the present embodiment has the additional advantage over the embodiment illustrated in FIGS. 5 and 6 in that a visitor can "program" an audible announcement or message in response to an occupant's message by speaking into a microphone to generate a message for storage and playback by the occupant.

As shown in FIG. 7, one presently preferred embodiment of a remote module of the present invention comprises a speech controller integrated circuit 700 which is substantially similar in function to an integrated telephone dialer. The speech controller integrated circuit 700 comprises a microphone preamplifier 702, a hands-free speakerphone circuit 704, loudspeaker amplifier 706 and means for transmitting and receiving a generated audible announcement or message 710. Preferably, the means for transmitting and receiving a generated audible announcement or message comprises a radio frequency transmitter/receiver, however, any other suitable transmission means or wireless intercom system can be used so long as it satisfies the purposes and objects of the present invention. In addition, a tone generator (not shown) can be provided for transmitting a tone over an audio path which interfaces by wireless intercom with a control module (FIG. 8). Tones generated by the tone generator provide means for signalling the control module that the doorbell actuation means on the facing of the remote module has been actuated and the internal programming routines of the programmable doorbell control engaged.

The speech controller integrated circuit 700 of the remote module is preferably housed within a small housing unit having a front facing which incorporates a doorbell actuation means 716 and an audio record button. As illustrated in the present design, the doorbell actuation means 716 incorporates a conventional pushbutton switch. It will be readily appreciated, however, that other conventional doorbell actuation means, such as, for example, a pressure sensitive switch, a touch sensitive switch, a slide switch, a momentary or non-momentary switch, a pressure sensitive floor mat, an infrared beam, etc. are possible.

In one presently preferred embodiment, the internal programming circuitry of the remote module is powered by a stand-alone battery power source or by means of solar power. In this regard, the remote module can be removably mounted as a self-contained unit on the exterior surface of a building or house near an entrance therein. It is also an important feature of the present invention to acknowledge that in place of a battery power source, power can be applied to the remote module from existing house AC or DC power supply through the existing house doorbell wiring, as illustrated in FIG. 5.

Since the remote module of a presently preferred embodiment of the present invention is self-contained without requiring an electrical interface with existing house doorbell wiring to power the doorbell and intercom system for transmitting and receiving audible announcements or messages, battery life is important. In this regard, the speech controller integrated circuit 700 normally lies dormant until the internal programming routines of the remote module are activated by an actuation of the doorbell actuation means 716.

When the doorbell actuation means 716 is actuated and the doorbell circuit disabled, electrical power is applied to a low-power set/reset (S/R) latch 708 and doorbell actuation switch 716 to generate the playback of an audible announcement or message recorded by the occupant. The S/R latch 708 preferably draws very little power from the power source (measured in the micro ampere range) to extend the life of the internal battery. The actuation of the doorbell switch 716 asserts a "SET" to the S/R latch 708. This sets a "Q" output of the S/R latch "on" or high (Q). The power output is maintained by the S/R latch 708 as long as the "Q" output is maintained high. The "Q" output will remain high until a "RESET" is sent to the S/R latch 708.

In the present embodiment, as long as sound is generated and/or transmitted by the internal speech controller circuit and interactive components of the remote or control module (FIG. 8), the "RESET" mode will not be generated. When sound is longer being generated, the "RESET" will be initiated and the doorbell circuit opened thus removing the power supply. It will be readily appreciated by those skilled in the art that other possible modifications and/or system adaptations for generating a "RESET", such as, for example, using a voice activated switch, are possible which are consistent with the spirit and scope of the present invention.

Reference is next made to FIG. 8, which illustrates one presently preferred embodiment of a control module of the present invention which comprises a speech controller integrated circuit 800 that is substantially similar in internal systems design and configuration as the internal speech circuitry of the remote module described in FIG. 7. The speech controller integrated circuit 800 of the control module includes a microphone preamplifier 802, a hands-free speakerphone circuit 804, loudspeaker amplifier 806 and means for transmitting and receiving a generated audible announcement or message 810. Preferably, the means for transmitting and receiving a generated audible announcement or message comprises a radio frequency transmitter/receiver, however, any other suitable transmission means or wireless intercom system can be used so long as it satisfies the purposes and objects of the present invention.

Preferably, the speech controller integrated circuit 800 of the control module is housed within a housing unit having a front facing which incorporates an audio record button 816 and an LED. The presently preferred embodiment of the control module provides internal programming circuitry which is powered by electrical power supplied from the existing house AC or DC power supply through existing house doorbell wiring, as illustrated in FIG. 5. It is an important feature of the present invention, however, that the control module of the present invention could be powered by a stand-alone battery power source as described in correlation with the remote module above.

A ring detector (not shown) can be provided within the internal housing of the control module for sensing tones generated by the tone generator and transmitted by means of the wireless intercom system from the remote module to the control module. Tones which are received by the ring detector of the control module provide an indication that the doorbell actuation means 716 of the remote device has been actuated, thereby activating the internal speech controller integrated circuit 800 of the control module to playback a previously recorded audible announcement or message generated by an occupant.

Preferably, the speech controller integrated circuit 800 of the control module interfaces with a microcomputer 812 and ISD chip 814. The microcomputer 812 in combination with the speech controller integrated circuit 800 provides means for storing analog electrical signals generated by the microphone 802 on the ISD chip 814. It will be readily appreciated, however, that other audible recording components, such as, for example, a micro-miniature tape recording unit, an analog-to-digital converter storage means, etc. are possible. When the doorbell actuation means on the face of the remote module is actuated, the microprocessor 812 assists the speech controller integrated circuit 800 in retrieving stored analog electrical signals from the ISD chip 814 to generate the occupant's audible announcement or message. Those skilled in the art will readily recognize that other possible modifications and adaptations for storing and converting audible announcements which are consistent with the spirit and scope of the present invention, such as, for example, using an analog-to-digital convertor or a speech synthesizer (as described in FIGS. 5 and 6) to generate a recording, storage and/or playback of an audible announcement, are possible.

To program an audible announcement or message, an occupant preferably depresses and holds an audio record button (or switch) 816 which activates the record mode of the speech controller integrated circuit 800. The microcomputer 812 sets the playback/record line 818 of the integrated speech controller circuit 800 to a Record mode and asserts a Chip Enable line (CE) 820. The speech controller integrated circuit 800 stores the audible announcement or message presented to its microphone input pins (RECORD) as long as the CE line 820 is maintained asserted.

The electrical analog signals representative of the audible announcement or message recorded and stored by the speech controller integrated circuit 800 of the control module can be activated for playback on the remote module when the doorbell actuation means is actuated. Upon actuation of the doorbell actuation means 716, the tone generator generates a tone which is decoded as a ringing sound detect by the ring detector interfacing with the speech controller integrated circuit 800 of the control module. The speech controller integrated circuit 800 sends a sound detection to the ring detect pin of the microcomputer 812, thereby activating the internal programming routines of the microcomputer 812.

When a tone is received from the remote module, the microcomputer 812 of the control module activates its internal memory and retrieves those analog electrical signals stored on the ISD chip 814 which represent the audible announcement or message recorded by the occupant. The microcomputer 812 performs this function by setting the playback/record pin 818 to the "P" state, and asserting the Chip Enable (CE) pin 820. The speech controller integrated circuit 800 thereafter accesses the audible announcement and plays back the entire recorded message until an internal end-of-message EOM mark is sensed as disclosed in FIG. 6.

Referring back to FIG. 7, the remote module includes means for receiving and transmitting a generated audible announcement or message 710 which preferably comprises a wireless intercom system. It will be readily appreciated by those skilled in the art, however, that other suitable means for transmitting and receiving audible transmissions are possible. In operation, the actuation of the doorbell actuation means 716 causes a signal (tone) to be transmitted to the control module whereby the occupant's stored audible announcement or message is generated by the speech controller integrated circuit 800 of the control module and transmitted over the wireless intercom system to be played back on the loudspeaker 706 of the remote module. Preferably, a means for adjusting the volume output of the loudspeaker 706 is provided to control the volume output of the doorbell chime and the playback of an audible announcement or message.

Utilizing radio frequency transmissions or other suitable means of communication, the self-contained remote module provides a wireless intercom system which facilitates numerous functional aspects which would not otherwise be capable of fitting within the small housing of the remote module. Moreover, through the interface of the speech controller integrated circuit 700 and internal components of the remote module, a visitor can generate an audible announcement or message in response to the occupant's audible announcement. In this regard, a visitor's audible announcement or message is encoded by the speech controller integrated circuit 700 of the remote module and transmitted via the wireless intercom system to the control module where the visitor's message can be recorded for later playback by the occupant. In current design, a conventional LED is provided on the exterior front facing of the control module which flashes to represent recorded messages.

Other functions of the control module such as an Erase switch 824 for erasing stored audible announcements or messages, may be initiated by the occupant. To erase a recorded announcement or message stored by the microcomputer 812 on the ISD chip 814, the occupant preferably actuates or presses the Erase switch 824. The microcomputer 812 will then refuse to enter the Playback function mode where the P/R pin is set to Playback, until a message has been recorded again.

To review a previously recorded message, the Playback message function may be initiated by pressing a Play switch 822. The microcomputer 812 does this function by setting the P/R pin 818 to the "P" state, and asserting the Chip Enable (CE) pin 820. The speech controller integrated circuit 800 will playback the entire audible announcement or message until an internal end-of-message EOM mark is sensed as disclosed in FIG. 6.

Although the foregoing preferred embodiments of the programmable doorbell control of the present invention have been described, it will be apparent to one skilled in the art that various modifications to the details of construction shown and described may be made without departing from the spirit and scope of this invention. Accordingly, the described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. A programmable doorbell system for controlling a doorbell which is connected to, and activated by a doorbell actuation means, said system comprising:

means for communicating a message comprising a display means and audio record and playback circuitry;

means for generating time-of-day signals;

means responsive to a first one of said time-of-day signals for disconnecting said doorbell from said doorbell actuation means and for enabling said communication means to communicate said message; and means responsive to a second one of said time-of-day signals for connecting said doorbell to said doorbell actuation means and for disabling said communication means.

2. A programmable doorbell system as defined in claim 1 wherein said doorbell actuation means comprises a push-button switch.

3. A programmable doorbell system as defined in claim 1 wherein said display means comprises a liquid crystal display which displays one of a plurality of messages, and wherein said programmable doorbell system comprises means for storing and selecting one of said plurality of messages for display by said display means.

4. A programmable doorbell system as defined in claim 1 wherein said audio record and playback circuitry includes a microphone, speech controller integrated circuitry and an output speaker circuit.

5. A programmable doorbell system as defined in claim 1 wherein said time-of-day signal generating means comprises an internal system clock for generating said time-of-day signals, a memory for storing a current time-of-day, an enable time and/or a disable time, and means for comparing said time-of-day signals to said stored enable signal to generate said first one of said time-of-day signals and to said stored disable signal to generate said second one of said time-of-day signals.

6. A programmable doorbell system as defined in claim 1 further comprising means responsive to said first one of said time-of-day signals and the actuation of said doorbell actuation means for generating means to alert a visitor to acknowledge said communication means.

7. A programmable doorbell system as defined in claim 6 wherein said means for alerting said visitor includes a tone generator comprising an oscillator and transducer which produces a short tone burst for generating an audible frequency suitable for signalling purposes.

8. A programmable doorbell system according to claim 1 further comprising a manually operated means for causing said disconnecting means to disconnect said doorbell from said doorbell actuation means and to enable said communication means irrespective of said first one of said time-of-day signals.

9. A self-contained doorbell system for controlling a doorbell, said doorbell system comprising:

a doorbell actuation means;

a power supply for providing power to said doorbell system when said doorbell actuation means is actuated;

means for converting an audible announcement into electrical signals, said converting means comprising audio record and playback circuitry;

means for storing said signals, wherein said storage means comprises internal memory capacity;

means responsive to said stored signals and to actuation of said doorbell actuation means for generating an audible reproduction of said audible announcement, said generating means comprising speech controller integrated circuitry and a speaker output circuit for generating said audible announcement; and a housing unit for housing said doorbell actuation means, said converting means, said storage means and said means for generating said audible reproduction of said audible announcement.

10. A self-contained doorbell system as defined in claim 9 further comprising means for disconnecting said doorbell from said doorbell actuation means so that said doorbell does not ring when said doorbell actuation means is actuated, but said audible reproduction of said audible announcement is generated.

11. A self-contained doorbell system as defined in claim 10 wherein said disconnecting means comprises a switch connected in series with said doorbell and said doorbell actuation means and a manually-controlled means for opening said switch to disconnect the doorbell and the doorbell actuation means.

12. A self-contained doorbell system as defined in claim 9 wherein said doorbell actuation means comprises a switch.

13. A self-contained doorbell system as defined in claim 9 wherein said power supply comprises a battery power source.

14. A self-contained doorbell system as defined in claim 9 wherein said power supply comprises means for interfacing said doorbell system with existing electrical household wiring.

15. A self-contained doorbell system as defined in claim 9 wherein said audio record and playback circuitry includes a microphone and speech controller integrated circuitry for converting said audible announcement into analog electrical signals.

16. A self-contained doorbell system as defined in claim 9 wherein said audio record and playback circuitry includes a microphone for converting said audible announcement into analog electrical signals and a speech encoder circuit for converting said analog electrical signals into digital signals.

17. A self-contained doorbell system as defined in claim 9 wherein said storage means comprises a speech controller integrated circuit chip for storing said electrical signals.

18. A self-contained doorbell system as defined in claim 9 comprising a control module and a remote module housing said doorbell actuation means.

19. A self-contained doorbell system as defined in claim 18 further comprising means for receiving and transmitting said audible announcement between said control module and said remote module.

20. A self-contained doorbell system as defined in claim 19 wherein said means for receiving and transmitting said audible announcement comprises a wireless intercom system.

21. A self-contained doorbell system as defined in claim 18 wherein said control module comprises a microphone, speech controller integrated circuitry and a speaker output circuit.

22. A self-contained doorbell system as defined in claim 20 wherein said control module further comprises a ring detector for sensing tones generated by said remote module.

23. A self-contained doorbell system as defined in claim 18 wherein said remote module comprises a microphone, speech controller integrated circuitry, a means for communicating with said control module and a speaker output circuit.

24. A self-contained doorbell system as defined in claim 23 wherein said remote module further comprises a tone generator for generating a tone which is transmitted by a communication means for signaling said control module that said doorbell actuation means has been activated.

25. A self-contained doorbell system as defined in claim 24 wherein said communication means comprises a wireless intercom system.

26. A self-contained doorbell system as defined in claim 9 wherein said speech controller integrated circuitry interfaces with a microcomputer to provide record and playback functions.

27. A self-contained doorbell system as defined in claim 9 wherein said converting means comprises a microphone and speech controller integrated circuitry for converting said audible announcement into analog electrical signals.

28. A self-contained doorbell system as defined in claim 27 wherein said converting means further comprises a speech encoder circuit for converting said analog electrical signals digital signals.

29. A self-contained doorbell system as defined in claim 9 wherein said storage means comprises a speech controller integrated circuit chip for storing analog electrical signals.

* * * * *